US009416592B2

(12) United States Patent
Sitka

(10) Patent No.: US 9,416,592 B2
(45) **Date of Patent: *Aug. 16, 2016**

(54) GENERATING FLUID TELEMETRY

(71) Applicant: Halliburton Energy Services, Inc., Houston, TX (US)

(72) Inventor: Mark A. Sitka, Richmond, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 285 days.

This patent is subject to a terminal disclaimer.

(21) Appl. No.: 13/969,723

(22) Filed: Aug. 19, 2013

(65) Prior Publication Data

US 2013/0333948 A1 Dec. 19, 2013

Related U.S. Application Data

(63) Continuation of application No. 13/386,072, filed as application No. PCT/US2009/051516 on Jul. 23, 2009, now Pat. No. 8,514,657.

(51) Int. Cl.

| | |
|---|---|
| ***E21B 4/02*** | (2006.01) |
| ***E21B 47/12*** | (2012.01) |
| ***E21B 47/18*** | (2012.01) |

(52) U.S. Cl.

CPC ..... *E21B 4/02* (2013.01); *E21B 47/185* (2013.01); *E21B 47/187* (2013.01); *E21B 47/12* (2013.01); *E21B 47/18* (2013.01); *E21B 47/182* (2013.01)

(58) Field of Classification Search

CPC ..... E21B 47/12; E21B 47/18; E21B 47/182; E21B 47/185; E21B 47/187; E21B 21/103

USPC ..... 361/81, 83, 84; 340/853.1, 854.3

See application file for complete search history.

(56) References Cited

U.S. PATENT DOCUMENTS

| | | | |
|---|---|---|---|
| 3,309,656 | A | 3/1967 | Godbey |
| 4,134,100 | A | 1/1979 | Funke |
| 4,630,244 | A | 12/1986 | Larronde |
| 4,785,300 | A | 11/1988 | Chin et al. |
| 5,182,731 | A | 1/1993 | Hoelscher et al. |

(Continued)

OTHER PUBLICATIONS

Notification Concerning Transmittal of International Preliminary Report on Patentability (1 page) and International Preliminary Report on Patentability (5 pages) for PCT/US2009/051516, mailed Feb. 2, 2012.

(Continued)

*Primary Examiner* — Hai Phan
*Assistant Examiner* — Franklin Balseca
(74) *Attorney, Agent, or Firm* — John W. Wustenberg; Fish & Richardson P.C.

(57) ABSTRACT

A downhole tool includes a tool body, stator, and rotor. The tool body is aligned along a tool centerline and includes an aperture therethrough operable to pass a fluid to an exterior of the body. The stator is fixed relative to the tool body and includes a fluid flow restriction operable to pass at least a portion of the fluid from an interior of the stator to the exterior of the body at an adjustable flow rate. The rotor is disposed within the tool body and rotatable relative to the stator and includes an exhaust port selectively aligned with at least one aperture through the tool body by rotation of the rotor relative to the stator. The exhaust port is operable to pass at least a portion of the fluid from an interior of the rotor to the exterior of the body when aligned with the aperture.

25 Claims, 3 Drawing Sheets

(56) References Cited

U.S. PATENT DOCUMENTS

| | | | | |
|---|---|---|---|---|
| 5,375,098 | A | 12/1994 | Malone et al. | |
| 5,586,084 | A | 12/1996 | Barron et al. | |
| 5,740,126 | A | 4/1998 | Chin et al. | |
| 5,787,052 | A | 7/1998 | Gardner et al. | |
| 6,469,637 | B1 | 10/2002 | Seyler et al. | |
| 6,626,253 | B2 | 9/2003 | Hahn et al. | |
| 6,636,159 | B1 | 10/2003 | Winnacker | |
| 6,714,138 | B1 | 3/2004 | Turner et al. | |
| 7,280,432 | B2 | 10/2007 | Hahn et al. | |
| 7,327,634 | B2 | 2/2008 | Perry et al. | |
| 7,417,920 | B2 * | 8/2008 | Hahn | E21B 47/182 175/40 |
| 7,735,579 | B2 * | 6/2010 | Gopalan | E21B 47/187 175/40 |
| 7,757,781 | B2 * | 7/2010 | Hay | E21B 4/02 175/107 |
| 8,162,078 | B2 * | 4/2012 | Anderson | E21B 7/24 166/177.2 |
| 8,514,657 | B2 * | 8/2013 | Sitka | E21B 47/185 340/854.3 |
| 2002/0105858 | A1 | 8/2002 | Winnacker | |
| 2004/0027917 | A1 | 2/2004 | Winnacker | |

OTHER PUBLICATIONS

International Search Report and Written Opinion for PCT/US2009/051516 mailed Sep. 9, 2009, 7 pages.

* cited by examiner

GENERATING FLUID TELEMETRY

CROSS-REFERENCE TO RELATED APPLICATION

This application is a continuation of, and claims priority under 35 U.S.C. §120 to, U.S. National Phase application Ser. No. 13/386,072 filed on Jan. 20, 2012, which is set to issue on Aug. 20, 2013 as U.S. Pat. No. 8,514,657, which in turn claims priority from International Application Serial No. PCT/US2009/051516, filed on Jul. 23, 2009. The International Application was published on Jan. 27, 2011 as International Publication No. WO 2011/011005 A1 under PCT Article 21(2). The contents of the above applications are incorporated herein by reference in their entirety.

TECHNICAL BACKGROUND

This disclosure relates to mud pulse telemetry for transmitting data from within a wellbore.

BACKGROUND

Drilling operations often rely on measured data indicative of wellbore conditions to adjust or modify an ongoing or current operation. For example, wellbore data, such as data indicative of a drilling fluid (i.e., a drilling "mud"), one or more subterranean zones, one or more components of a downhole drilling apparatus, or other information, may be used in determining drilling direction, drilling speed, or operation characteristics, to name but a few examples. For instance, one technique for obtaining wellbore data measured in a drilled borehole is the use of a measurement-while-drilling ("MWD") telemetry system. As another example, measured data from logging-while-drilling ("LWD") systems is often transmitted to the surface by a fluid, or mud, telemetry system. In such systems, data measured in the borehole, such as data measured by sensors or transducers positioned within a downhole drilling apparatus, may be transmitted to a surface detector while drilling is in progress by varying one or more characteristics of the drilling fluid used in the drilling operation. In short, such systems may include one or more components that relay the measured information to the surface through a column of drilling fluid within the borehole which extends from the bottom of the borehole to the surface during drilling.

DETAILED DESCRIPTION

Figure 1:
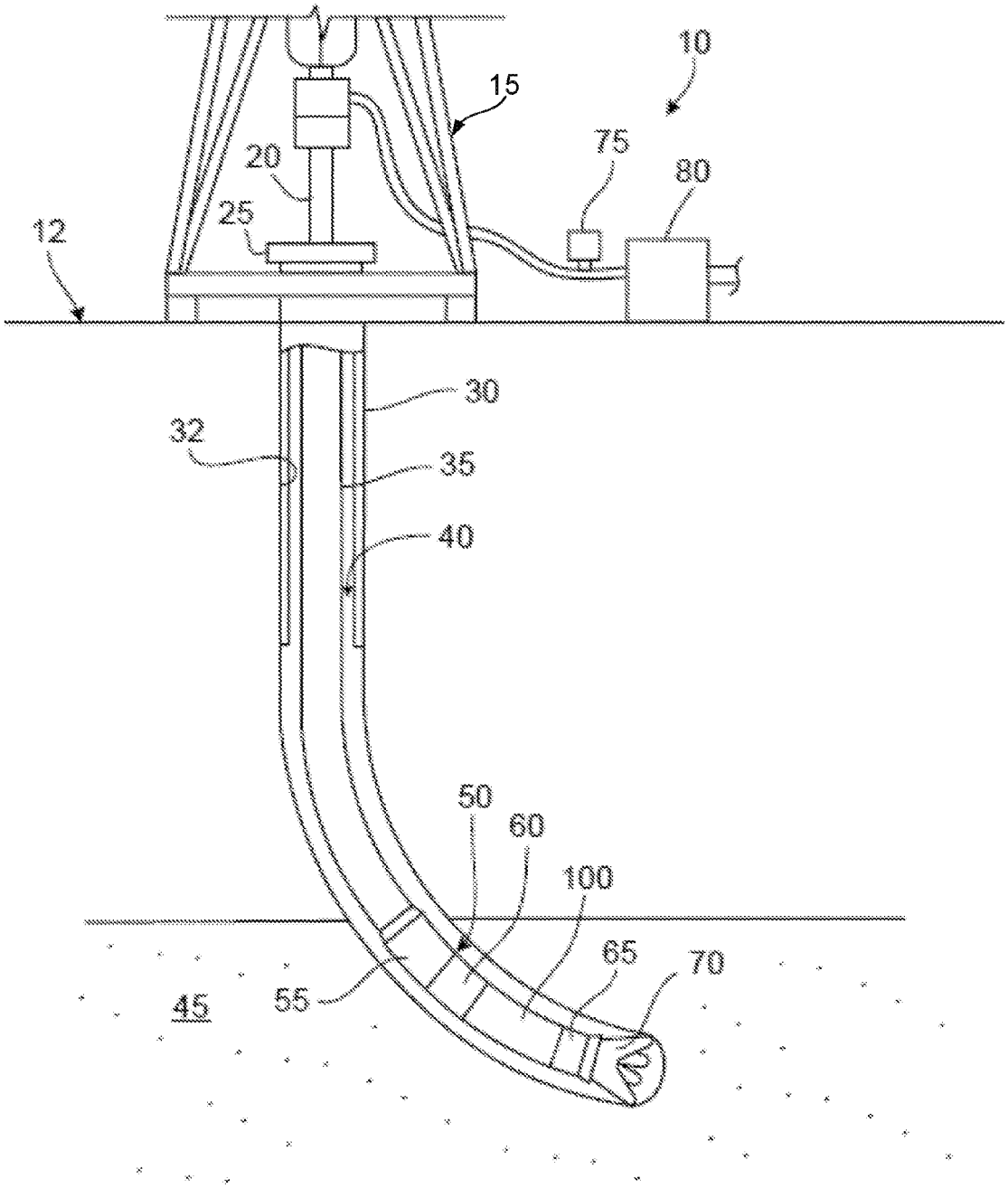
FIG. 1 illustrates a drilling assembly including one embodiment of a mud pulser in accordance with the present disclosure.

In one general embodiment, a downhole tool includes a tool body, a stator, and a rotor. The tool body is aligned longitudinally along a centerline of the tool, where the tool body includes at least one aperture therethrough that is operable to pass a fluid to an exterior of the body. The stator is fixed relative to the tool body and includes at least one fluid flow restriction that is operable to pass at least a portion of the fluid from an interior of the stator to the exterior of the body at an adjustable flow rate. The rotor is disposed within the tool body and rotatable relative to the stator, where the rotor includes at least one exhaust port selectively aligned with at least one aperture through the tool body by rotation of the rotor relative to the stator. The exhaust port is operable to pass at least a portion of the fluid from an interior of the rotor to the aperture and to the exterior of the body when aligned with the aperture.

In more specific embodiments, the restriction may include at least one valve disposed at an outlet of the stator, where the valve may receive the fluid passing through the stator. The valve may include one of a knife valve, a needle valve, or a gate valve. Further, at least a portion of the stator may be disposed in the interior of the rotor. The rotor may include an inner surface and the stator may include an outer surface. The inner surface may be adjacent and substantially parallel to the outer surface, where the inner and outer surfaces include a fluid interface between the rotor and the stator. The fluid interface may include a turbine, where the turbine receives fluid therethrough and rotates the rotor relative to the stator. In some aspects, the fluid interface may include a lobed interface, where the lobed interface receives fluid therethrough and rotates the rotor relative to the stator. In addition, the fluid interface may receive the fluid therethrough to rotate the rotor relative to the stator at an adjustable angular speed. The angular speed may be adjusted by throttling the restriction to vary a flow rate of fluid.

In certain embodiments, the tool body may further include a clutch, where the clutch adjusts an angular speed of the rotor relative to the stator based on a received signal indicative of a measured drilling value. The clutch may adjust the rotor between a first angular speed and a second angular speed, where the first angular speed may be substantially equal to zero revolutions per minute and the second angular speed is greater than the first angular speed. In some aspects, the tool may receive the fluid from a terranean surface, where the fluid passes to the exterior of the tool body from at least one of the restriction and the aperture and returned to the terranean surface in an annulus between the downhole tool and a wellbore. Further, at least one of selective alignment of the exhaust port with the aperture and adjustment of the flow rate may generate varying amplitudes of a pressure of the fluid. The at least one restriction may further include a first valve and the adjustable flow rate may be a first adjustable flow rate, where the stator may include a second valve allowing the fluid to pass to the exterior of the body at a second adjustable flow rate.

In another general embodiment, a method for generating mud pulse telemetry includes: receiving a fluid from a terranean surface at a downhole tool including a tool body; directing the fluid through an interior of the tool body and between a rotor and stator disposed within the tool body; adjusting a rotation of the rotor to align at least one exhaust port through the rotor with a corresponding aperture through the tool body to direct at least a portion of the fluid from the interior of the tool body to an exterior of the tool body; directing the fluid through the stator to an outlet of the stator, the outlet includes an adjustable restriction; and adjusting the restriction to vary passage of at least a portion of the fluid from the interior of the tool body to the exterior of the tool body from the outlet.

In some specific embodiments, the method may further include passing at least a portion of the fluid between the rotor and stator to generate rotation of the rotor relative to the stator.

Further, at least one of adjusting rotation of the rotor to align at least one exhaust port through the rotor with a corresponding aperture through the tool body to direct at least a portion of the fluid to an exterior of the tool body from the interior of the tool body and adjusting the restriction to allow at least a portion of the fluid to pass to the exterior of the tool body from the outlet may include adjusting an amplitude of pressure of the fluid received from the terranean surface. At least one of adjusting rotation of the rotor to align at least one exhaust port through the rotor with a corresponding aperture through the tool body to direct at least a portion of the fluid to an exterior of the tool body from the interior of the tool body and adjusting the restriction to allow at least a portion of the fluid to pass to the exterior of the tool body from the outlet may include adjusting a frequency of pressure of the fluid received from the terranean surface.

In certain embodiments, the method may further include receiving at least one signal indicative of a measured drilling value; and adjusting, based on the at least one signal, at least one of rotation of the rotor and the restriction. Adjusting, based on the at least one signal, at least one of rotation of the rotor and the restriction may include adjusting a pressure of the fluid received from the terranean surface. The method may further include measuring, adjacent the terranean surface, the adjusted pressure of the fluid; and determining the measured drilling value based on the adjusted pressure. Adjusting, based on the at least one signal, at least one of rotation of the rotor and the restriction may also include adjusting a frequency of a fluid pressure of the fluid received from the terranean surface. The method may further include measuring, adjacent the terranean surface, the adjusted frequency of the fluid pressure of the fluid; and determining the measured drilling value based on the adjusted frequency.

In specific embodiments, receiving a fluid from a terranean surface may include receiving a fluid from a terranean surface at a first flow rate and the method may further include receiving the fluid from the terranean surface at a second flow rate distinct from the first flow rate; and adjusting the restriction based on a difference between the first flow rate and the second flow rate. In addition, adjusting a rotation of the rotor may include holding the rotor at a first fixed position, where the exhaust port may be misaligned with the corresponding aperture at the first fixed position; based on the rotor at the first fixed position, directing the fluid through a standpipe disposed through at least a portion of the stator; adjusting the rotor from the first fixed position to a second fixed position, where the exhaust port may be at least partially aligned with the corresponding aperture at the second fixed position; and based on the rotor at the second fixed position, directing at least a portion of the fluid to the exterior of the tool body from the interior of the tool body.

In another general embodiment, a system includes a drill string and a mud pulser. The drill string includes a drill bit; a sensor section; and a downhole measurement tool. The mud pulser is coupled to the drill string and includes a housing including a plurality of apertures therethrough; a first element disposed within the housing and fixed relative to the housing, where the first element is operable to direct a variable portion of the drilling fluid through the first element to an exterior of the housing; and a second element disposed within the housing and rotatable relative to the housing based on a flow of drilling fluid received between the first and second elements. The second element includes a plurality of exhaust ports operable to be selectively aligned with the plurality of apertures by rotation of the second element to direct a portion of the drilling fluid from an interior of the second element to the exterior of the housing. In specific embodiments, the mud pulser may receive the drilling fluid at a first pressure, where the drilling fluid may be adjusted to a second pressure based on at least one of directing a varying portion of the drilling fluid through the first element to an exterior of the housing and alignment of the plurality of exhaust ports with the plurality of apertures by rotation of the second element to direct a portion of the drilling fluid from an interior of the second element to the exterior of the housing. The system may further include a speed adjustment module coupled to at least one of the housing and the second element, where the speed adjustment module may control an angular speed of the second element relative to the housing.

In certain embodiments of the system, the downhole measurement tool may be communicatively coupled to the speed adjustment module and may detect a plurality of drilling values. The speed adjustment module may control the angular speed of the second element relative to the housing based on the plurality of drilling values. The plurality of drilling values may include at least two of a well bore pressure; a resistivity of the drilling fluid; a conductivity of the drilling fluid; a temperature of the drilling fluid; a resistivity of a subterranean formation; a conductivity of the subterranean formation; a density of the subterranean formation; and a porosity of the subterranean formation.

Various embodiments of a mud pulser according to the present disclosure may include one or more of the following features. For example, in some embodiments, the mud pulser may generate a negative mud pulse pressure signal to transmit measured borehole data to a surface or sub-surface location. Further, the mud pulser may be powered predominantly by a drilling mud pumped downhole into the wellbore. The mud pulser may provide for variable pressure amplitude for mud pulse telemetry. The mud pulser may also provide for variable pressure frequency for mud pulse telemetry. The mud pulser may also provide an inverted mud motor or turbine design thereby allowing for easier flow of the drilling mud through the pulser as well as control of the rotating element therein. In addition, the mud pulser may include multiple exhaust ports allowing drilling mud to be selectively exhausted from the pulser, thereby allowing for an increased data rate of mud pulse telemetry. In some embodiments, the mud pulser may allow for downhole adjustment for varying drilling mud flow rates by one or more adjustable restrictions, or valves, as well as the multiple exhaust ports.

Various embodiments of a mud pulser according to the present disclosure may also include one or more of the following features. For example, the mud pulser may allow for a less complex construction and assembly as compared to traditional mud pulse telemetry techniques and devices. For example, in some embodiments, one or more signal-carrying media (e.g., wires) may be coupled to a non-rotating component of the mud pulser, thereby decreasing electrical failures. Further, the mud pulser may include a multi-step control regime, such that multiple pressure amplitudes of the drilling fluid may be generated. For example, the multiple exhaust ports and/or restrictions may be controlled in parallel or in series to fluctuate the fluid pressure of the drilling fluid, thereby increasing telemetry rates. Other advantages and features of the mud pulser in accordance with the present disclosure will be apparent from the figures and the description.

FIG. 1 illustrates a drilling assembly 10 including one embodiment of a mud pulser 100 in accordance with the present disclosure. The illustrated drilling assembly 10 includes a drilling rig 15 located at a terranean surface 12 and supporting a drill string (or pipe) 35. The drill string 35 is generally disposed through a rotary table 25 and into a wellbore 30 that is being drilled through a subterranean zone 45.

An annulus 40 is defined between the drill string 35 and the wellbore 30. In some embodiments, at least a portion of the wellbore 30 may be cased. For example, drilling assembly 10 may include a casing 32 cemented in place within the wellbore 30. The casing 32 (e.g., steel, fiberglass, or other material, as appropriate) may extend through all or a portion of the subterranean zone 45.

Generally, subterranean zone 45 may include a hydrocarbon (e.g., oil, gas) bearing formation, such as shale, sandstone, or coal, to name but a few examples. In some embodiments, the subterranean zone 45 may include a portion or all of one or multiple geological formations beneath the terranean surface 12. For example, the drill string 35 may be disposed through multiple subterranean zones and at multiple angles. Although FIG. 1 illustrates a directional wellbore 30, the present disclosure contemplates and includes a vertically-drilled wellbore and multiple types of directionally-drilled wellbores, such as high angle wellbores, horizontal wellbores, articulated wellbores, or curved wellbores (e.g., a short or long radius wellbore). In short, the wellbore 30 may be a vertical borehole or deviated borehole or may include varying sections of vertical and deviated boreholes.

In some embodiments, the drill string 35 may include a kelly 20 at an upper end, as illustrated in FIG. 1. The drill string 35 may be coupled to the kelly 20, and a bottom hole assembly ("BHA") 50 may be coupled to a downhole end of the drill string 35. The BHA 50 typically includes one or more drill collars 55, a downhole measurement tool 60 (e.g., MWD or LWD), and a drill bit 70 for penetrating through earth formations to create the wellbore 30. In one embodiment, the kelly 20, the drill string 35 and the BHA 50 may be rotated by the rotary table 25. Alternatively, rotation may be imparted to one or more of the components of the drilling assembly 10 by a top direct drive system.

FIG. 1 shows one configuration including the BHA 50, which may be rotated by a downhole motor driven by, for example, electrical power or a flow of drilling fluid. In some embodiments, the BHA 50 may include the downhole mud motor used to provide rotational power to the BHA 50. Drill collars 55 may be used to add weight on the drill bit 70 and to stiffen the BHA 50, thereby allowing the BHA 50 to transmit weight to the drill bit 70 without buckling or experiencing a structural failure. The weight applied through the drill collars 55 to the bit 70 may allow the drill bit 70 to cut material in the subterranean zone 45, thereby creating the wellbore 30 in the zone 45.

As the drill bit 70 operates, drilling fluid or "mud" is pumped from the terranean surface 12 through a conduit coupled to a mud pump 80 to the kelly 20. The drilling fluid is then transmitted into the drill string 35, through the BHA 50 and eventually to the drill bit 70. The drilling fluid is discharged from the drill bit 70 and, typically, cools and lubricates the drill bit 70 and transports at least a portion of rock or earth cuttings made by the bit 70 to the terranean surface 12 via the annulus 40. The drilling fluid is then often filtered and reused by pumping it back through the drill string 35.

In general, this recirculating column of drilling fluid flowing through the drill string 35 may also provide a medium for transmitting pressure pulse acoustic wave signals, carrying information from the BHA 50 to the surface 12. In certain embodiments, such signals may be representative of one or more wellbore characteristics or measured values that may be gathered by a sensor section 65 (or other measurement devices) located in the BHA 50. The sensor section 65 may include one or multiple sensors or transducers mounted in the section 65 that measure a variety of downhole conditions and generate electrical signals representative of such conditions. Generally, such sensors and transducers may be specific to the drilling operation and/or the downhole measurement tool 60 and may measure such conditions as: location of the drill bit 70; rotational speed of the drill bit 70; a downhole pressure; a temperature, resistivity or conductivity of the drilling fluid; a temperature, resistivity, density, porosity, or conductivity of one or more subterranean zones, as well as various other downhole conditions.

The downhole measurement tool 60 may be located as close to the drill bit 70 as practical. Signals representing information from the sensor section 65, as described above, may be generated and stored in the downhole measurement tool 60. For example, the signals representative of data may be stored in the downhole measurement tool 60 and retrieved at the surface 12 when drilling operations are completed. Alternatively, or additionally, some or all of the signals may be transmitted in the form of mud pulses (e.g., varying pressures of the drilling fluid) upward through the drill string 35. Further, some or all of the signals may be transmitted as mud pulses upward through the annulus 40. A pressure pulse traveling in the column of drilling fluid within the drill string 35 (or annulus 40) may be detected at the surface 12 by a telemetry detector 75. Such signals received by the telemetry detector 75 may be decoded at the detector 75 and/or at a remote processing system (not shown).

The BHA 50 also includes a mud pulser 100 to selectively interrupt or obstruct the flow of drilling fluid through the drill string 35, and thereby produce pressure pulses at varying amplitudes and/or frequencies. In illustrated embodiments, as shown and described with reference to FIGS. 2 and 3A-B, the mud pulser 100 may include an inverted mud motor or turbine design with a stationary stator disposed within a rotor that is selectively rotated relative to the stator and pulser body to interrupt or obstruct, or conversely exhaust, the flow of drilling fluid through the pulser 100. The rotor and stator of the mud pulser 100 are distinct from, for example, a rotor/stator combination that may be included within a downhole mud motor included in the drilling assembly 10. In the illustrated embodiments, the pulser 100 may also include one or more restrictions therethrough to throttle (e.g., obstruct or interrupt) the drilling fluid as it flows through the stator portion of the pulser 100. Thus, the combination or selective operation of the rotor and restrictions may allow for multiple levels of control to achieve various pressure adjustments (e.g., amplitude, frequency) in the pressure of the drilling fluid as measured by the telemetry detector 75.

Figure 2:
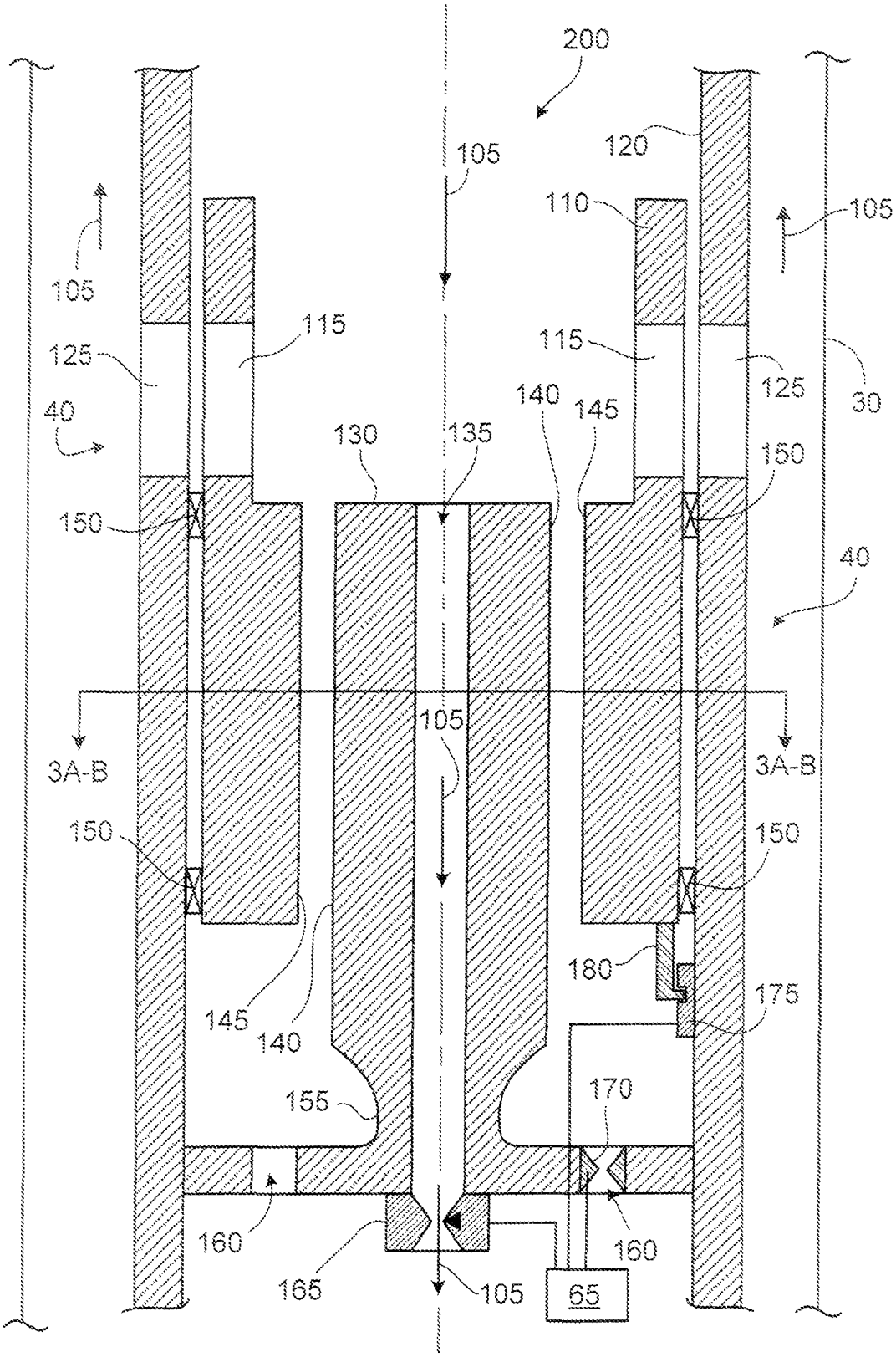
FIG. 2 illustrates a sectional view of one embodiment of a mud pulser in accordance with the present disclosure.

FIG. 2 illustrates a sectional view of one embodiment of a mud pulser 200 in accordance with the present disclosure. In some embodiments, the mud pulser 200 may be used as the mud pulser 100 described with reference to the drilling assembly 10 of FIG. 1. As illustrated, the mud pulser 200 includes a body 120, a rotor 110 disposed within an interior cavity defined by the body 120, and a stator 130 disposed within the interior cavity of the body 120. As shown, the rotor 110 is disposed between the stator 130 and the body 120. The mud pulser 200 also includes one or more bearings 150 disposed between the rotor 110 and the body 120. As shown, the mud pulser 200 is inserted into a wellbore, such as the wellbore 30, and receives a drilling fluid 105 from an uphole portion of the wellbore 30.

The illustrated mud pulser body 120 may be constructed of an appropriate material able to operate in a downhole environment. For example, the body 120 is generally rigid and able to withstand the corrosive effects of, for instance, the drilling fluid 105 as it flows in contact with the body 120. As illustrated, the body 120 includes one or more apertures 125 disposed through the body 120 and allowing fluid communication between the interior of the mud pulser 200 and the annulus 40. Generally, such apertures 125 allow the drilling fluid 105 to be selectively and controllably exhausted from the mud pulser 200 into the annulus 40, thereby adjusting, at least in part, the drilling fluid pressure. Although two apertures 125 are illustrated, more or less apertures may be formed through the body 120 as appropriate. In addition, the body 120 is coupled (threadingly or otherwise) to other components of the drill string and may be fixed against rotation relative to the drill string.

The rotor 110 is disposed within the body 120 and, generally, may freely rotate relative to the body 120 and the stator 130 as the drilling fluid 105 is pumped through the mud pulser 200. While rotating or stationary, the rotor 110 may be supported by one or more bearings 150 situated between the body 120 and the rotor 110. The bearings 150 may, in some embodiments, be sealed bearings. Alternatively, the bearings 150 may be unsealed or compensated bearings, or may also be radial bearings that may withstand thrust loads placed on the rotor 110, the body 120, or other components of the mud pulser 200. In any event, the bearings 150 typically are resistant to any corrosive effects of the drilling fluid 105 and allow the rotor 110 to achieve rotation without directly contacting the body 120 or the stator 130.

The rotor 110, as shown, includes one or more exhaust ports 115 disposed though an upper portion of the rotor 110. Such exhaust ports 115 may be selectively aligned with the apertures 125 in the mud pulser 200. For example, the exhaust ports 115 and apertures 125 may be identical or substantially similar in shape and area. Alternatively, the exhaust ports 115 may be larger or smaller than the apertures 125. In any event, the exhaust ports 115 of the rotor 110 may allow for fluid communication through the apertures 125 and to the annulus 40 upon rotational alignment of the ports 115 with corresponding apertures 125. Thus, at least a portion of the drilling fluid 105 may be directed to the annulus 40 rather than, for example, through a standpipe 135 disposed through the stator 130.

In some embodiments, an interface between the rotor 110 and the body 120 may include one or more "shear" valve characteristics. For instance, adjacent surfaces of the rotor 110 and the body 120 may be highly polished metal surfaces, thereby fitting tightly together. Thus, a pressure differential across the gap between such surfaces may be very high (e.g., 2500 psi), thereby substantially preventing the drilling fluid 105 from entering the gap between the rotor 110 and body 120 from the exhaust ports 115 or apertures 125.

The stator 130 is disposed within at least a portion of the rotor 110 and in the interior cavity defined by the body 120. As illustrated, the stator 130 is affixed to the body 120 and is stationary relative to the body 120. Thus, as shown, the mud pulser 200 includes an inverted mud motor design such that an interior element (e.g., the stator 130) is fixed and an exterior element (e.g., the rotor 110) rotates upon the pumping of drilling fluid 105 through the mud pulser 200.

As shown, the stator 130 includes a flared portion affixed to the body 120, thereby creating a rigid connection to the body 120. A reduced diameter portion of the stator 130 adjacent the rotor 110 is coupled to the flared portion and includes the standpipe 135 disposed therethrough. In some embodiments, the reduced-diameter portion is coupled to the flared portion by a flex shaft 155. For instance, as described below with reference to FIGS. 3A-B, the mud pulser 200 may include a turbine arrangement or, alternatively, a progressive cavity (e.g., Moineau) arrangement. In a progressive cavity arrangement, the flex shaft 155 may allow for the reduced-diameter portion of the stator 130 to move radially around its longitudinal axis or, in other words, "wobble," without rotating about its axis. Such movement may allow for proper operation of the stator/rotor combination as the drilling fluid 105 is pumped through the mud pulser 200. In a mud motor, or turbine, arrangement, the flex shaft 155 may be substantially rigid and, thus, the stator 130 may not wobble as the drilling fluid 105 is pumped through the mud pulser 200. Further, in some embodiments including a mud motor, or turbine, arrangement, the rotor 110 and stator 130 may include reverse-pitch blades on one or both of the rotor and stator in order to, for instance, improve turbine performance.

Figure 3A:
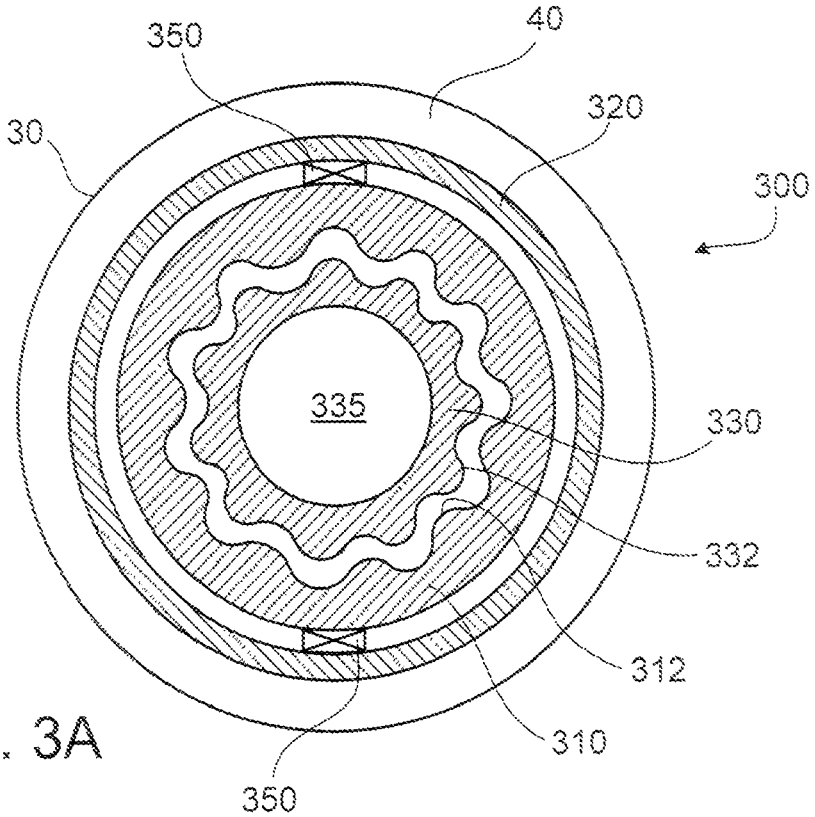
FIG. 3A illustrates a sectional view of one embodiment of a mud pulser utilizing a turbine arrangement in accordance with the present disclosure.

In some embodiments, as shown in FIG. 2, the stator 130 includes an outer surface 140 and the rotor 110 contains an inner surface 145 adjacent the outer surface 140 that cooperate to cause the rotor 110 to rotate about its longitudinal axis with respect to the stator 130 in response to fluid flow between the rotor 110 and stator 130. The interface between the inner surface 140 and the outer surface 145 may depend, for example, on the arrangement of mud pulser 200 as a turbine design or a progressive cavity (or Moineau) design. For instance, turning to FIG. 3A, a sectional view of one embodiment of a mud pulser 300 utilizing a turbine arrangement is illustrated. The mud pulser 300 includes a body 320, a rotor 310, a stator 330, and one or more bearings 350 disposed between the body 320 and the rotor 310. Generally, the components of the mud pulser 300 may be substantially similar to those described above with respect to the mud pulser 200. As illustrated in FIG. 3A, in a turbine arrangement, the rotor 310 and the stator 330 may include a contoured inner surface 312 and a contoured outer surface 332, respectively. Such contoured surfaces 312 and 332 may include channels disposed longitudinally on the rotor 310 and stator 330, thereby allowing the drilling fluid 105 to flow therein. As the drilling fluid 105 flows across the contoured surfaces 312 and 332, the rotor 310 rotates about the stator 330 and relative to the body 320. In such fashion, the rotor 310 may be rotated such that exhaust ports (not shown) may be aligned with corresponding apertures of the body 320.

Figure 3B:
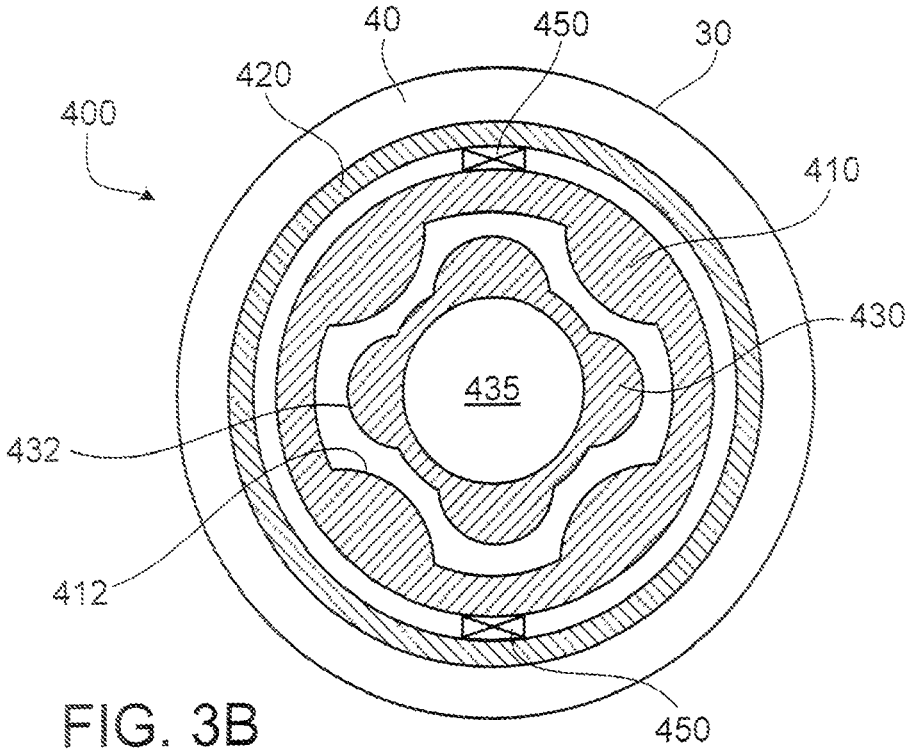
FIG. 3B illustrates a sectional view of another embodiment of a mud pulser utilizing a progressive cavity, or Moineau, arrangement in accordance with the present disclosure.

Turning to FIG. 3B, a sectional view of another embodiment of a mud pulser 400 utilizing a progressive cavity, or Moineau, arrangement is illustrated. The mud pulser 400 includes a body 420, a rotor 410, a stator 430, and one or more bearings 450 disposed between the body 420 and the rotor 410. Generally, the components of the mud pulser 400 may be substantially similar to those described above with respect to the mud pulser 200 and/or mud pulser 300. As illustrated in FIG. 3B, in a progressive cavity, or Moineau, arrangement, the rotor 410 and the stator 430 may include a lobed inner surface 412 and a lobed outer surface 432, respectively. Such lobed surfaces 412 and 432 may provide an interface through which the drilling fluid 105 may flow between the rotor 410 and stator 430. As the drilling fluid 105 flows between the lobed surfaces 412 and 432, the rotor 410 rotates about the stator 430 and relative to the body 420. In such fashion, the rotor 410 may be rotated such that exhaust ports (not shown) may be aligned with corresponding apertures of the body 420.

Returning to FIG. 2, the mud pulser 200 may also include a standpipe valve 165 arranged at an outlet of the standpipe 135 disposed through the stator 130. In some embodiments, the standpipe valve 165 may be attached to or coupled with the stator 130 (or another non-rotating portion of the pulser 200) and removable, such as when servicing the mud pulser 200. Alternatively, the standpipe valve 165 may be formed integral with the stator 130 in a one-piece arrangement. Generally, the standpipe valve 165 provides a variable restriction to flow of the drilling fluid 105 through the standpipe 135 and restrict at least a portion of the drilling fluid 105 as it flows to one or more tools downhole of the mud pulser 200, such as the drill bit 70. In certain instances, the standpipe valve 165 may be adjusted to provide a greater or less restriction on the standpipe 135 based on, for example, measured downhole values detected by one or more sensors, or the sensor section 65 for instance. By adjusting the restriction of the standpipe valve 165, more or less drilling fluid 105 may be restricted, thereby adjusting the pressure of the drilling fluid 105 at or near the terranean surface 12. In some embodiments, adjustments of the pressure of the drilling fluid 105 may be monitored at the terranean surface 12 and decoded to determine one or more drilling variables, downhole data (e.g., pressure, temperature), drilling measurement data, or other types of information. As adjustments are made in the pressure of the drilling fluid 105 by the mud pulser 200 at faster rates, more data may be transmitted to, and thus monitored at, the terranean surface 12. Additionally, while the mud pulser 200 may transmit negative mud pulse signals through the drilling fluid 105 in some embodiments, other embodiments may allow for positive mud pulse signals to be transmitted through the drilling fluid 105.

In some implementations, the standpipe valve 165 may be a knife or gate valve, operable to close or open based on a signal received from the sensor section 65. In some embodiments, the standpipe valve 165 may fully shut-off drilling fluid from reaching the drill bit 70. In some embodiments, the standpipe valve 165 may be a needle valve. In some embodiments, the standpipe valve 165 may not provide a full shut-off position. Further, in some embodiments, the standpipe valve 165 may include multiple restrictions or valves. Accordingly, reference to a single standpipe valve 165 is also intended to encompass configurations with multiple standpipe valves 165.

The flared portion of the stator 130 may also include one or more stator exhausts 160 disposed through the flared portion parallel to the direction of flow of the drilling fluid 105 through the stator 130. Each stator exhaust 160 (or none of the stator exhausts 160) may include an exhaust valve 170. The exhaust valve 170 may also provide another variable restriction to flow of the drilling fluid 105 as it passes between the rotor 110 and the stator 130. Thus, as the drilling fluid 105 is restricted from flowing to one or more downhole tools, the fluid pressure of the drilling fluid 105 may be increased. As illustrated, the exhaust valve 170 may be communicably coupled and/or controlled by the sensor section 65. Thus, the sensor section 65 may control one or more exhaust valves 170 to open and/or close, thus restricting the drilling fluid 105 from passing to one or more downhole components. The mud pulser 200 may therefore provide up to 4 or more (or less as appropriate) steps of pressure control by which the fluid pressure of the drilling fluid 105 may be controllably increased and/or decreased.

As illustrated, the mud pulser 200 may also include a clutch 175 affixed to or integral with the body 120 and a clutch arm 180 affixed to the rotor 110. Generally, the clutch 175 and clutch arm 180 work in conjunction as a brake to slow and/or stop rotation of the rotor 110 as the drilling fluid 105 flows between the rotor 110 and the stator 130. For example, the clutch 175 may stop rotation of the rotor 110 through frictional contact with the clutch arm 180 such that the exhaust ports 115 are selectively aligned or misaligned with corresponding apertures 125. In short, the clutch 175 may controllably hold and/or release the rotor 110 to release the drilling fluid 105 through the aligned ports 115 and apertures 125, thereby increasing and/or decreasing the fluid pressure of the drilling fluid 105 uphole of the mud pulser 200.

In some embodiments, the clutch 175 may be controlled by a telemetry, or control portion, such as the sensor section 65. As illustrated, for example, the clutch 175 may be communicably coupled to the sensor section 65. Further, the clutch 175 and/or the sensor section 65 may receive positional feedback indicating a position of the rotor 110 (e.g., "open" where the ports 115 are fully or partly aligned with the apertures 125). In some embodiments, the clutch 175 may include a solenoid or a cylinder with a magnet coil in the body 120 that may start and stop the clutch 175. In some aspects, the clutch 175 may be a disc type clutch; an electrical clutch; and or an electromechanical clutch. Further, the clutch 175 may include more than one clutches, or brakes, as well as multiple corresponding clutch arms.

With references to FIGS. 1-2, one example operation of the mud pulser 200 in accordance with the present disclosure is described. As drilling fluid 105 is pumped down the drill string 35 during drilling, MWD, and/or LWD operations, fluid 105 is transmitted to the mud pulser 200 (or 100) in the BHA 50. Simultaneously, the sensor section 65 may be measuring one or more downhole values to be transmitted to the terranean surface 12. Through a combination of hardware (e.g., processors, ASICs, analog or digital circuitry) and/or software (e.g., middleware, source code, one or more child and/or parent applications or modules) contained in, for example, the sensor section 65 or other component of the BHA 50 or drilling assembly 10, one or more signals are transmitted to at least one of the clutch 175, the standpipe valve 165, and one or more exhaust valves 170. Such signals (e.g., PWM, 0-5 VDC, 0-20 mA) may, for example, selectively operate the clutch 175 to start and/or stop rotation of the rotor 110 to release the drilling fluid 105 through the exhaust ports 115 and aligned apertures 125 or direct the drilling fluid 105 through the standpipe 135 and/or between the rotor 110 and stator 130. The signals may also cause the standpipe valve 165 to increase or decrease the restriction to flow of the drilling fluid 105 through the standpipe 136 to one or more tools downhole from the mud pulser 200. Further, the signals may also cause one or more exhaust valves 170 to selectively release drilling fluid 105 downhole of the mud pulser 200 or hold the drilling fluid 105 in the mud pulser 200.

By selectively operating one or more of the clutch 175, the standpipe valve 165 and one or more exhaust valves 170, the fluid pressure of the drilling fluid 105 in the drill string 35 may be controllably increased and decreased based on the measured downhole data. Thus, mud pulse telemetry may be generated and measured at the terranean surface 12 by, for example, the telemetry detector 75. In such fashion, the measured data may be transmitted through the column of drilling fluid 105 by varying one or both of the amplitude of the fluid pressure of the drilling fluid 105 or the frequency of changes in the fluid pressure of the drilling fluid 105. Other operations of the mud pulser 200 described in the present disclosure may also be implemented. As one example, the mud pulser 200 may be operated (e.g., the standpipe valve 170 adjusted) based on an increase or decrease of a flow rate of the drilling fluid 105 pumped through the drill string 35. Further, in some embodiments, a mud pulser according to the present disclosure may be implemented with wired pipe or a wireline arrangement rather than a drill string or drill pipe.

A number of embodiments have been described. Nevertheless, it will be understood that various modifications may be made. Accordingly, other embodiments are within the scope of the following claims.

What is claimed is:

1. A downhole tool comprising:

a tool body aligned longitudinally along a centerline of the tool, the tool body comprising at least one aperture there through that is operable to pass a fluid to an exterior of the body;

a stator fixed relative to the tool body and comprising a first fluid flow restriction that is operable to pass at least a portion of the fluid from an interior of the stator to the exterior of the body at an adjustable flow rate, the stator comprising an outer radial surface; and a rotor disposed within the tool body and rotatable relative to the stator such that a fluid interface is defined between the rotor and stator, the rotor comprising an inner radial surface and at least one exhaust port selectively aligned with at least one aperture through the tool body by rotation of the rotor relative to the stator, the exhaust port operable to pass at least a portion of the fluid from an interior of the rotor to the aperture and to the exterior of the body when aligned with the aperture, the fluid interface defined between the inner radial surface of the rotor and the outer radial surface of the stator and comprising a fluid bypass between the rotor and the stator that comprises a second fluid flow restriction;

wherein the inner radial surface of the rotor and the outer radial surface of the stator are adjacent and parallel along the centerline of the tool.

2. The downhole tool of claim 1, wherein the first fluid flow restriction comprises at least one valve disposed at an outlet of the stator, the valve receiving the fluid passing through the stator.

3. The downhole tool of claim 2, wherein the valve comprises one of a knife valve, a needle valve, or a gate valve.

4. The downhole tool of claim 1, wherein at least a portion of the stator is disposed in the interior of the rotor.

5. The downhole tool of claim 1, wherein the fluid interface comprises at least one of:

a turbine configured to receive the fluid therethrough and rotate the rotor relative to the stator; or a lobed interface configured to receive the fluid therethrough and rotate the rotor relative to the stator.

6. The downhole tool of claim 1, wherein the fluid interface is configured to receive the fluid therethrough to rotate the rotor relative to the stator at an adjustable angular speed.

7. The downhole tool of claim 6, further comprising a controller, the controller operable to adjust the angular speed by throttling the first fluid flow restriction to vary a flow rate of fluid.

8. The downhole tool of claim 1, further comprising a clutch configured to adjust an angular speed of the rotor relative to the stator based on a received signal indicative of a measured drilling value.

9. The downhole tool of claim 8, wherein the clutch is configured to adjust the rotor between a first angular speed and a second angular speed, the first angular speed substantially equal to zero revolutions per minute, the second angular speed greater than the first angular speed.

10. The downhole tool of claim 1, wherein the tool receives the fluid from a terranean surface, the fluid passing to the exterior of the tool body from at least one of the first fluid flow restriction, the second fluid flow restriction, or the aperture, and returned to the terranean surface in an annulus between the downhole tool and a wellbore.

11. The downhole tool of claim 1, wherein at least one of selective alignment of the exhaust port with the aperture and adjustment of the flow rate generates varying amplitudes of a pressure of the fluid.

12. The downhole tool of claim 1, wherein the second fluid flow restriction comprises one or more outlets in a downhole portion of the stator.

13. The downhole tool of claim 12, further comprising an adjustable valve disposed in at least one of the one or more outlets.

14. A method for generating mud pulse telemetry comprising:

receiving a fluid from a terranean surface at a downhole tool comprising a tool body aligned longitudinally along a centerline of the tool;

directing a portion of the fluid through an interior of the tool body and through a fluid interface between an inner radial surface of a rotor and an outer radial surface of a stator disposed within the tool body, the fluid interface comprising a first fluid flow restriction, and wherein the inner radial surface of the rotor and the outer radial surface of the stator are adjacent and parallel along the centerline of the tool;

adjusting a rotation of the rotor to align at least one exhaust port through the rotor with a corresponding aperture through the tool body to direct at least a portion of the fluid from the interior of the tool body to an exterior of the tool body;

directing a portion of the fluid through the stator to an outlet of the stator, the outlet comprising a second fluid flow restriction; and adjusting the second fluid flow restriction to vary passage of at least a portion of the fluid from the interior of the tool body to the exterior of the tool body from the outlet.

15. The method of claim 14, further comprising passing at least a portion of the fluid between the rotor and stator to generate rotation of the rotor relative to the stator.

16. The method of claim 14, further comprising adjusting an amplitude of pressure of the fluid received from the terranean surface based at least in part on adjusting rotation of the rotor to align at least one exhaust port through the rotor with a corresponding aperture through the tool body.

17. The method of claim 14, further comprising adjusting an amplitude of pressure of the fluid received from the terranean surface based at least in part on adjusting the second fluid flow restriction to allow at least a portion of the fluid to pass to the exterior of the tool body from the outlet.

18. The method of claim 14, further comprising adjusting an amplitude of pressure of the fluid received from the terranean surface based at least in part on adjusting the first fluid flow restriction to allow at least a portion of the fluid to pass to the exterior of the tool body from the fluid interface.

19. The method of claim 14, further comprising adjusting a frequency of pressure of the fluid received from the terranean surface based at least in part on one or more of:

adjusting rotation of the rotor to align at least one exhaust port through the rotor with a corresponding aperture through the tool body to direct at least a portion of the fluid to an exterior of the tool body from the interior of the tool body;

adjusting the second fluid flow restriction to allow at least a portion of the fluid to pass to the exterior of the tool body from the outlet comprises; or adjusting the first fluid flow restriction to allow at least a portion of the fluid to pass to the exterior of the tool body from the fluid interface.

20. The method of claim 14, further comprising:

receiving at least one signal indicative of a measured drilling value; and adjusting, based on the at least one signal, at least one of rotation of the rotor, the first fluid flow restriction, or the second fluid flow restriction.

21. The method of claim 20, wherein adjusting, based on the at least one signal, at least one of rotation of the rotor, the first fluid flow restriction, or the second fluid flow restriction comprises adjusting a pressure of the fluid received from the terranean surface, the method further comprising:

measuring, adjacent the terranean surface, the adjusted pressure of the fluid; and determining the measured drilling value based on the adjusted pressure.

22. The method of claim 20, wherein adjusting, based on the at least one signal, at least one of rotation of the rotor, the first fluid flow restriction, or the second fluid flow restriction comprises adjusting a frequency of a fluid pressure of the fluid received from the terranean surface, the method further comprising:

measuring, adjacent the terranean surface, the adjusted frequency of the fluid pressure of the fluid; and determining the measured drilling value based on the adjusted frequency.

23. The method of claim 14, wherein receiving a fluid from a terranean surface comprises receiving a fluid from a terranean surface at a first flow rate, the method further comprising:

receiving the fluid from the terranean surface at a second flow rate distinct from the first flow rate; and adjusting at least one of the first or second fluid flow restrictions based on a difference between the first flow rate and the second flow rate.

24. The method of claim 14, wherein adjusting a rotation of the rotor comprises:

holding the rotor at a first fixed position, the exhaust port misaligned with the corresponding aperture at the first fixed position;

based on the rotor at the first fixed position, directing the fluid through a standpipe disposed through at least a portion of the stator;

adjusting the rotor from the first fixed position to a second fixed position, the exhaust port aligned with the corresponding aperture at the second fixed position; and based on the rotor at the second fixed position, directing at least a portion of the fluid to the exterior of the tool body from the interior of the tool body.

25. The method of claim 14, further comprising:

adjusting the second fluid flow restriction to vary passage of at least a portion of the fluid from the interior of the tool body to the exterior of the tool body from the outlet.

* * * * *